United States Patent [19]

Schaffer

[11] Patent Number: 5,051,686

[45] Date of Patent: Sep. 24, 1991

[54] BANDGAP VOLTAGE REFERENCE

[75] Inventor: Gregory L. Schaffer, Cupertino, Calif.

[73] Assignee: Maxim Integrated Products, Sunnyvale, Calif.

[21] Appl. No.: 604,742

[22] Filed: Oct. 26, 1990

[51] Int. Cl.[5] ..... G05F 3/22

[52] U.S. Cl. ..... 323/313; 323/314; 307/296.6

[58] Field of Search ..... 323/312, 313, 314, 315, 323/316; 307/296.1, 296.6

[56] References Cited

U.S. PATENT DOCUMENTS

| | | | |
|---|---|---|---|
| 3,887,863 | 6/1975 | Brokaw | 323/314 |
| 4,249,122 | 2/1981 | Widlar | 323/313 |
| 4,250,445 | 2/1981 | Brokaw | 323/313 |
| 4,348,633 | 9/1982 | Davis | 323/314 |
| 4,447,784 | 5/1984 | Dobkin | 323/313 |
| 4,795,961 | 1/1989 | Neidorff | 323/314 |
| 4,902,959 | 2/1990 | Brokaw | 323/314 |

*Primary Examiner*—Peter S. Wong

*Attorney, Agent, or Firm*—Blakely, Sokoloff, Taylor & Zafman

[57] ABSTRACT

A bandgap voltage reference of a unique design is disclosed. The reference utilizes a pair of transistors operating at different current densities to provide a current component through a resistor at the $\Delta V_{BE}$ of the two transistors. A second current component through the resistor is provided through another resistor connected to the common emitter connection of another pair of transistors, the collectors of the last named pair of transistors each being connected to one input of a operational amplifier, the output of which is the output of the circuit. In operation, the base of one of the last named pair of transistors is connected to a resistor divider on the circuit output and held at the bandgap voltage, the base of the other of the last named pair of transistors also being held at the bandgap voltage by being connected to a resistor divider between the collector of one of the two transistors operating at different current densities and the emitter of a fifth transistor, the base of the fifth transistor being connected to the resistor divider on the circuit output at a point corresponding to a voltage of two bandgap voltages. By proper selection of transistor size ratios and resistor ratios, a high degree of symmetry can be achieved.

14 Claims, 2 Drawing Sheets

BANDGAP VOLTAGE REFERENCE

BACKGROUND OF THE INVENTION

1. Field of the Invention

The present invention relates to the field of bandgap voltage references such as are used in voltage regulators and other integrated circuits.

2. Prior art

At least three prior art bandgap (bipolar technology) reference architectures are well known. All bandgap references use the same underlying principle: they generate a voltage proportional to absolute temperature ($V_{PTAT}$) which has a positive temperature coefficient, then they combine this voltage with the base-emitter voltage of a transistor (which has a negative temperature coefficient). When properly combined (e.g. with the proper weighting), the two temperature drifts cancel and one gets a voltage that is fairly independent of temperature. This voltage is typically around 1.23 V and is close to the bandgap voltage of silicon. Hence the name for these references.

FIGS. 1, 2, and 3 show existing bandgap architectures. One of the earliest is shown in FIG. 1. This was used in early 1.23 V reference designs at National Semiconductor (part LM113) and is covered by U.S. Pat. No. 4,249,122. In this circuit, Q2 is operated at 1/10 the current density of Q1. The difference in the $V_{BE}$s of Q1 and Q2 will be a $V_{PTAT}$. This voltaqe appears across R3 and gets amplified across R2 by the ratio R2/R3. Thus R2's voltage is a $V_{PTAT}$ voltage. Q3's $V_{BE}$ is in series with R2's voltage. By proper selection of the parameters, the positive temperature sensitivity of the $V_{PTAT}$ may be made substantially equal to the negative temperature sensitivity of Q3's $V_{BE}$. Under these conditions, the sum of these two voltages will be about 1.23 V. The foregoing reference works well with two terminal 1.23 V references driven by a current source, but doesn't lend itself well to references with higher voltages.

FIG. 2 shows the reference used in the LM185 (also by National Semiconductor) and covered by U.S. Pat. No. 4,447,784. Here Q1 and Q2 are operated at different current densities to give a $V_{PTAT}$ across R2. The resistors R1, R2 and R3, in series with the emitter-base junction of Q3, give the nominal 1.23 V bandgap reference voltage between the output terminal and the base of Q3. By using a voltage divider consisting of R4 and R5, one can get an output voltage, $V_{OUT}$, that is (R4+R5)/R4 times 1.23 V. Thus an arbitrary voltage (>1.23 V) can be generated. Q1 and Q2, in addition to providing the PTAT voltage, also serve as the first stage of an operational amplifier. The remainder of the amplifier is represented by A1.

FIG. 3 shows the Brokaw reference (analog Devices) covered by U.S. Pat. No. 3,887,863. Here the bases of Q1 and Q2 are tied together and the two transistors are operated at different current densities to give a PTAT voltage that appears across R1. By properly adjusting the value for R2, one gets a bandgap voltage from Q2's base-emitter voltage and the sum of the voltages across R1 and R2. This circuit, although functionally equivalent to that of FIG. 2, has a major advantage in that it eliminates the need for Q3 of FIG. 2. Thus it is a simpler circuit, and is now widely used.

BRIEF SUMMARY OF THE INVENTION

A bandgap voltage reference of a unique design is disclosed. The reference utilizes a pair of transistors operating at different current densities to provide a current component through a resistor at the $\Delta V_{BE}$ of the two transistors. A second current component through the resistor is provided through another resistor connected to the common emitter connection of another pair of transistors, the collectors of the last named pair of transistors each being connected to one input of a operational amplifier, the output of which is the output of the circuit. In operation, the base of one of the last named pair of transistors is connected to a resistor divider on the circuit output and held at the bandgap voltage, the base of the other of the last named pair of transistors also being held at the bandgap voltage by being connected to a resistor divider between the collector of one of the two transistors operating at different current densities and the emitter of a fifth transistor, the base of the fifth transistor being connected to the resistor divider on the circuit output at a point corresponding to a voltage of two bandgap voltages. By proper selection of transistor size ratios and resistor ratios, a high degree of symmetry can be achieved. Various design considerations and parameters are provided.

DETAILED DESCRIPTION OF THE INVENTION

The base-emitter voltage of a bipolar transistor can be accurately described by the equation:

$$V_{BE}=\{(kT/q)*ln[CI/(AT^N)]\}+V_{go} \quad (1)$$

where:

k=Boltzmann constant=$1.380662*10^{-23}$ Joules/(Degree Kelvin)

T=Temperature in Degrees Kelvin q=Electron Charge=$1.6021892*10^{-19}$ Coulombs

C=A process constant; about $3.7*10^6$ for a specific bipolar process

I=Emitter current of transistor in amps

A=Area Scaling Factor=1.0 for minimum sized transistor

Figure 4:
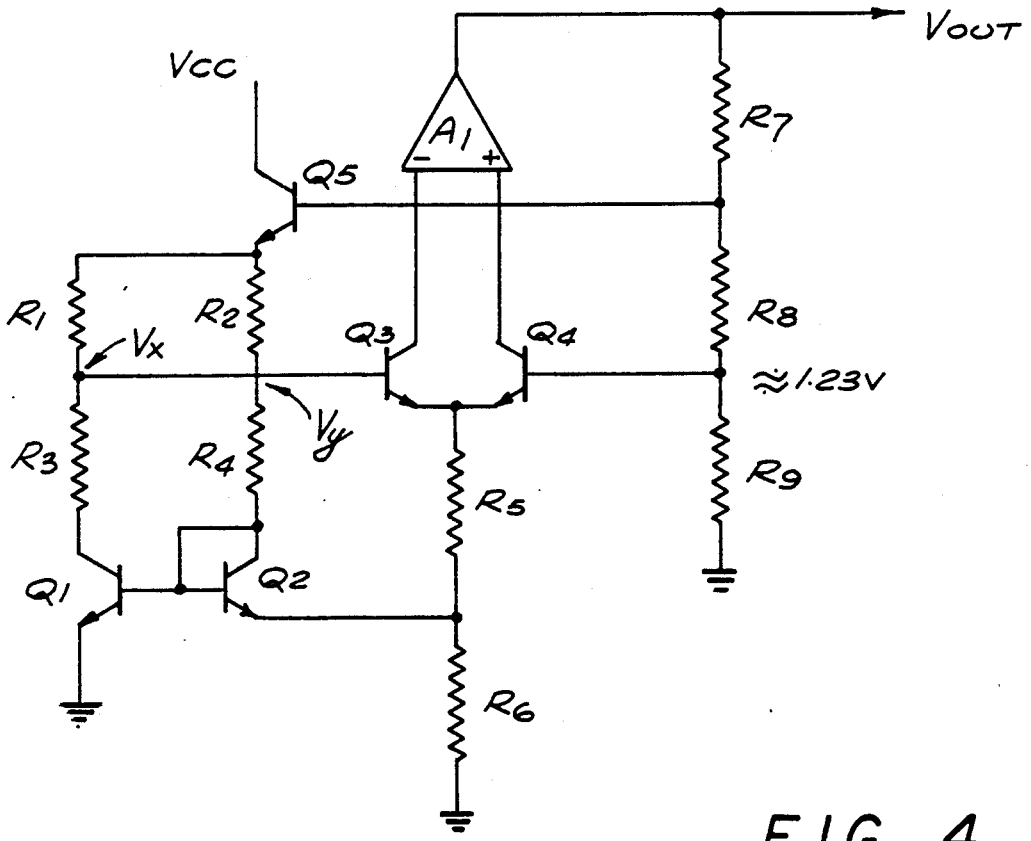
FIG. 4 is a schematic diagram of the bandgap voltage reference of the present invention.

N=A process dependent constant; about 4.15 for a specific process $V_{go}$=Bandgap voltage of silicon=1.155 V FIG. 4 illustrates the essential components of the new reference of the present invention. Five transistors (Q1 through Q5) and nine resistors comprise the reference. Q3 and Q4, in addition to being part of the reference circuit, also form the input stage of the operational amplifier A1. The details of A1 are not shown, as the same are not part of the invention. Transistors Q1 and Q5 run at the same current density, so their $V_{BE}$s are identical. Likewise Q2, Q3 and Q4 operate at identical current densities (M times lower than Q1 and Q5), so these three $V_{BE}$s are identical and are (kT/q)*ln(M) lower in value than the $V_{BE}$s of Q1 and Q5. (It isn't essential that Q3 and Q4 operate at the same current density as Q2, but that turns out to be a convenient operating point that also gives optimal performance.) Under balanced conditions, $V_x=V_y=V_{BG}$ and $I_{Q1}=I_{Q2}=I_{R5}=I$. This requires R1=R2=R3=R4=R5=R. The difference between the base-emitter voltages of Q1 and Q2 is:

$$v=(kT/q)*ln(M) \quad (2)$$

which is easily derived from equation (1). The current through R6 is just $v/R_6$, and this current=2*I. (Note that R6 is written as $R_6$ in the equations to avoid confusing the resistor identification as a multiplier.) Consequently, $$2*I = v/R_6 = (kT/qR_6)*\ln(M) \quad (3)$$

$$\text{thus } I*R = [(kT/q)*\ln(M)]*(R/2R_6)$$

The optimal bandgap voltage, $V_{BG}$, is equal to the sum of Q4's $V_{BE}(=V_{BE4})$, plus the drop across R5, plus the voltage v:

$$\begin{aligned} V_{BG} &= V_{BE4} + I*R + v \quad (4) \\ &= (kT/q)*\ln[C*(I/2)/((M/2)*T^N)] + V_{go} + [(kT/q)*\ln(M)]*(R/2R_6) + (kT/q)*\ln(M) \\ V_{BG} &= (kT/q)*\ln[C*I/(M*T^N)] + V_{go} + (kT/q)*\ln(M)*[1 + (R/2R_6)] \end{aligned}$$

Equation (4) has three terms. $V_{BE4}$ has a negative drift of about 2 mV/deg C., and $I_{R5}$ and v both have positive drifts. By properly selecting the ratio of $R/R_6$, one can get the two drifts to cancel. This exact cancellation takes place only at one temperature, $T_o$. The current, I, in these equations is a function of temperature. In fact, it is proportional to absolute temperature (PTAT). Therefore, we can express I as $I=T*I_o/T_o$. At temperature $T_o$, $I=I_o$. If we substitute this expression for I in equation (4), we get $$V_{BG} = (kT/q)*\ln[C*I_o/(T_o*M*T^{(N-1)})] + V_{go} + (kT/q)*\ln(M)*[1 + (R/2R_6)] \quad (5)$$

Taking the derivative of $V_{BG}$ with respect to T, and rearranging terms:

$$dV_{BG}/dT = (V_{BE} - V_{go})/T - (N-1)*k/q + (1 + R/2R_6)*(k/q)*\ln M \quad (6)$$

This can be set equal to zero at a specific temperature, $T_o$, which gives:

$$R/R_6=\{[(V_{go}-V_{BEO})/V_{To}+N-1]*2/(\ln M)\}-2 \quad (7)$$

where $V_{BEO}=V_{BE}$ at $T=T_o$, and $V_{To}=T_o*k/q$.

One finds that a typical value for $R/R_6$ is about 24. In general R8=R9, with the final output voltage Vout being determined by the value of R7 relative to R8 and R9, namely $Vout=V_{BG}*(R7+R8+R9)/R9$.

In normal operation, Q1 and Q2 will have equal currents therethrough, but because of their unequal areas, will operate at substantially different current densities. Thus with equal currents therethrough, there will be a fixed $\Delta V_{BE}$ difference between Q1 and Q2 regardless of the absolute magnitude of the equal currents. Under these conditions, there must be a fixed voltage on R6, namely the $\Delta V_{BE}$ difference. If by way of example, a sudden increase in load occurs on the output, Vout will dip momentarily. Because R8=R9, the dip on the base of Q5 will be twice the dip on the base of Q4. Also because the base of Q5 is 2 $V_{BE}$ plus the drops across the applicable resistors above ground, whereas the base of Q3 is half way therebetween as is the base of Q4, the circuit would remain balanced if the currents in Q1 and Q2 remained equal, as all currents would drop proportionally. This cannot happen however, as the dip in voltage across R6 due to the current drop therein is inconsistent with the fixed $\Delta V_{BE}$ drop in Q1 and Q2 if the value of the currents therein remain equal. Instead, the dip in the voltage on R5 unbalances the currents in Q1 and Q2, pulling the base of Q1 lower, turning Q1 toward off and thus Q3 on more so that the negative input to the amplifier is pulled low relative to the positive input. Thus the amplifier will drive Vout back up to again balance the circuit.

Figure 1:
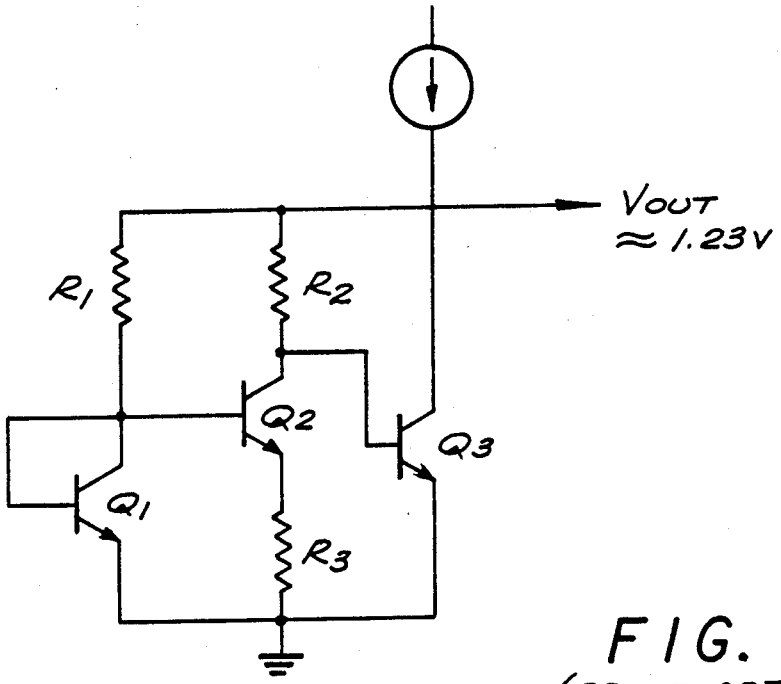
FIG. 1 (PRIOR ART)
FIG. 1 is a schematic diagram of a well known prior are bandgap voltage reference.
Figure 2:
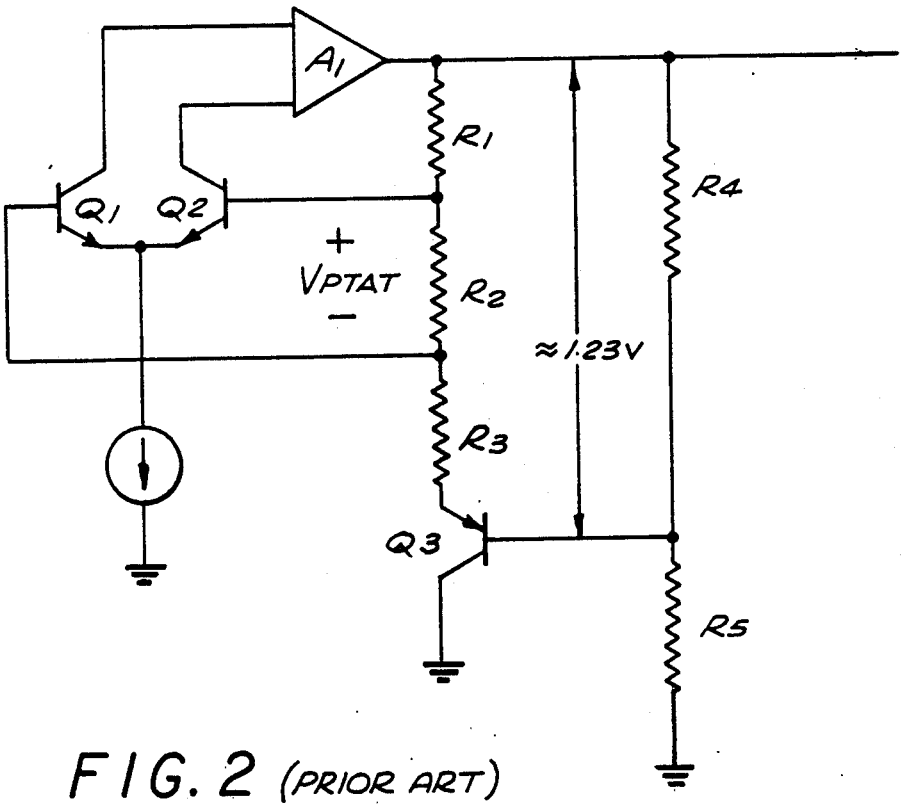
FIG. 2 (PRIOR ART)
FIG. 2 is a schematic diagram of another well known prior art bandgap voltage reference.
Figure 3:
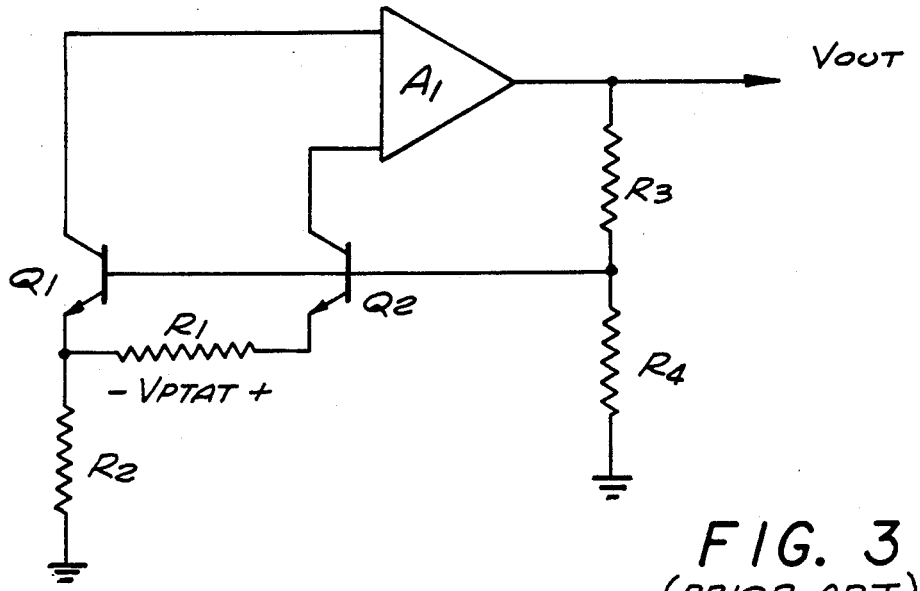
FIG. 3 (PRIOR ART)
FIG. 3 is a schematic diagram of still another well known prior art bandgap voltage reference.

Note that the circuit of FIG. 4 is more complex than the reference of FIG. 3, though its performance is very similar thereto. The circuit of the present invention has an advantage over the prior art however, which isn't immediately obvious from the design. In particular, resistors R2 and R4 have $V_{PTAT}$ voltages across them. Therefore one can use these to conveniently generate correction voltages that significantly reduce the "curvature error" of all bandgap references. Such a scheme would be difficult to implement with the reference of FIG. 3.

The curvature correction scheme uses pairs of transistors in a differential configuration (emitters tied together and driven by a current source). One base ties to a tap on either R2 or R4, and the other base ties to a tap on either R8 or R9. The voltages on R2 and R4 vary with temperature, but the voltages across R8 and R9 are fixed since $V_{OUT}$ is constant. Consequently, the difference in collector currents of the differential pair can be designed to have a characteristic drift with temperature. By using one or more of these differential pairs, one can get a correction current (the sum of difference in collector currents) that can be tailored to cancel out the systematic "curvature error" of the bandgap reference. The correction current is normally summed at the junction of R1 and R3.

In the embodiment shown, resistor R3 really isn't needed. Its primary purpose is to match the $V_{CE}$s of Q1 and Q2, but if R3 is left out, the ensuing error is quite small. Similarly, R2 and R4 are shown as separate resistors to aid in the understanding of the circuit, but typically are physically realized as a single resistor.

The preferred circuit is generally fabricated in integrated circuit form utilizing NPN transistors, though the same could also be realized using PNP transistors instead. Also current ratios and/or resistor ratios and/or device areas may be varied within limits as desired. By way of example, the area ratio of Q1 and Q2 may be varied provided R5 and R6 are changed accordingly. Similarly, Q1 and Q2 might even have equal areas provided that R1 through R4 are changed accordingly so that the current in Q1 is substantially higher than the current in Q2, though preferably the area of Q5 would also be changed accordingly so that the current density in Q5 approximates that of Q1. Similarly the ratio of currents in R5 and R6 may be varied, though the 1:2 ratio is preferred. Also for a $2V_{BG}$ reference, R7 may be eliminated (made substantially equal to zero). Thus it will be understood by those skilled in the art that these and other modifications of the present invention may be made without departing from the spirit and scope thereof.

With respect to the following claims, R2 and R4 are generally treated as a single resistance, and because of the same, the resistors and transistors as identified in the claims do not follow in the same numerical designation as described herein, but rather are ordered as follows:

| | |
|---|---|
| Q1 → | third transistor |
| Q2 → | fourth transistor |
| Q3 → | first transistor |
| Q4 → | second transistor |
| Q5 → | fifth transistor |
| R1 → | seventh resistor |
| R2 + R4 → | fifth resistor |
| R3 → | sixth resistor |
| R5 → | second resistor |
| R6 → | first resistor |
| R7 → | eighth resistor |
| R8 → | fourth resistor |
| R9 → | third resistor |

I claim:

1. An integrated circuit bandgap voltage reference comprising:

first, second, third, fourth and fifth transistors, all of the same conductivity type and each having an emitter, a base and a collector;

first, second, third, fourth, fifth, sixth and seventh resistors, each having first and second ends;

said first and second transistors having their emitters coupled together;

said first resistor having its first end coupled to a first power supply terminal and its second end coupled to the first end of said second resistor, said second resistor having its second end coupled to the emitters of said first and second transistors;

said third resistor having its first end coupled to said first power supply terminal and its second end coupled to the first end of said fourth resistor, said fourth resistor having its second end coupled to said output terminal, the junction between said third and fourth resistors being coupled to the base of said second transistor;

an operational amplifier having one input thereof coupled to the collector of said first transistor, a second input thereof coupled to the collector of said second transistor, and the output thereof coupled to said output terminal;

said third transistor having its emitter coupled to said first power supply terminal and its base coupled to said base and said collector of said fourth transistor;

said fourth transistor having its emitter coupled to the junction between said first and second resistors;

said fifth transistor having its collector coupled to a second power supply terminal, its base coupled to the second end of said fourth resistor and its emitter coupled to the collector of said fourth transistor through said fifth resistor;

said sixth resistor having its first end coupled to the collector of said third transistor and its second end coupled to the base of said first transistor;

said seventh resistor having its first end coupled to the second end of said sixth resistor and its second end coupled to the emitter of said fifth transistor;

said third transistor having a substantially higher current density therein than said fourth transistor when the differential input to said amplifier is substantially zero.

2. The integrated circuit bandgap voltage reference of claim 1 further comprising an eighth resistor and wherein said second end of said fourth resistor is coupled to said output terminal through said eighth resistor.

3. The integrated circuit bandgap voltage reference of claim 1 wherein said third and fourth resistors have substantially the same resistance, and wherein the resistances of said first and second resistors are chosen in relation to the difference in current densities in said third and fourth transistors so that the voltage on the base of said second transistor relative to the first power supply terminal is substantially equal to one bandgap voltage.

4. The integrated circuit bandgap voltage reference of claim 3 wherein the current density in said first transistor is equal to the current density in said second transistor when the differential input to said operational amplifier is substantially zero.

5. The integrated circuit bandgap voltage reference of claim 4 wherein the current density in said fourth transistor is equal to the current density in said first and second transistors when the differential input to said operational amplifier is substantially zero.

6. The integrated circuit bandgap voltage reference of claim 5 wherein the current density in said third transistor is equal to the current density in said fifth transistor when the differential input to said operational amplifier is substantially zero.

7. The integrated circuit bandgap voltage reference of claim 3 wherein the current density in said fifth transistor is equal to the current density in said third transistor.

8. The integrated circuit bandgap voltage reference of claim 7 wherein the current density in said first transistor is equal to the current density in said second transistor when the differential input to said operational amplifier is substantially zero.

9. The integrated circuit bandgap voltage reference of claim 1 wherein said first and second resistors have a resistance ratio chosen to provide a predetermined voltage temperature coefficient at the emitter of said second transistor.

10. The integrated circuit bandgap voltage reference of claim 1 wherein said first and second resistors have a resistance ratio chosen to provide a substantially zero voltage temperature coefficient at the base of said second transistor, whereby the voltage on the base of said second transistor relative to the first power supply terminal is substantially equal to one bandgap voltage.

11. An integrated circuit bandgap voltage reference comprising:

first, second, third, fourth and fifth transistors, all of the same conductivity type and each having an emitter, a base and a collector;

first, second, third, fourth, fifth, sixth and seventh resistors, each having first and second ends;

said first and second transistors having their emitters coupled together;

said first resistor having its first end coupled to a first power supply terminal and its second end coupled to the first end of said second resistor, said second resistor having its second end coupled to the emitters of said first and second transistors;

said third resistor having its first end coupled to said first power supply terminal and its second end coupled to the first end of said fourth resistor, said fourth resistor having its second end coupled to said output terminal, the junction between said third and fourth resistors being coupled to the base of said second transistor;

an operational amplifier having one input thereof coupled to the collector of said first transistor, a second input thereof coupled to the collector of said second transistor, and the output thereof coupled to said output terminal;

said third transistor having its emitter coupled to said first power supply terminal and its base coupled to said base and said collector of said fourth transistor;

said fourth transistor having its emitter coupled to the junction between said first and second resistors;

said fifth transistor having its collector coupled to a second power supply terminal, its base coupled to the second end of said fourth resistor and its emitter coupled to the collector of said fourth transistor through said fifth resistor;

said sixth resistor having its first end coupled to the collector of said third transistor and its second end coupled to the base of said first transistor;

said seventh resistor having its first end coupled to the second end of said sixth resistor and its second end coupled to the emitter of said fifth transistor;

the resistance of said third resistor being substantially equal to the resistance of said fourth resistor;

said third transistor having a substantially higher current density therein than said fourth transistor, the voltage on the base of said second transistor relative to the first power supply terminal being substantially one bandgap voltage, said first and second transistors having substantially the same current densities therein and said third and fifth transistors having substantially the same current densities therein, all when the differential input to said amplifier is substantially zero.

12. The integrated circuit bandgap voltage reference of claim 11 wherein the current density in the fourth transistor is equal to the current density in said first and second transistors when the differential input to said operational amplifier is substantially zero.

13. The integrated circuit bandgap voltage reference of claim 12 further comprising an eighth resistor and wherein said second end of said fourth resistor is coupled to said output terminal through said eighth resistor.

14. The integrated circuit bandgap voltage reference of claim 11 further comprising an eighth resistor and wherein said second end of said fourth resistor is coupled to said output terminal through said eighth resistor.

* * * * *